US009995066B1

(12) United States Patent
Ottolini et al.

(10) Patent No.: US 9,995,066 B1
(45) Date of Patent: Jun. 12, 2018

(54) VEHICLE DOOR OPENING MECHANISM

(71) Applicant: Inteva Products, LLC, Troy, MI (US)

(72) Inventors: Philippe Ottolini, La Voivre (FR); Pascal Philippe, Saulcy (FR); Mathias Barth, Azerailles (FR)

(73) Assignee: INTEVA PRODUCTS, LLC, Troy, MI (US)

( * ) Notice: Subject to any disclaimer, the term of this patent is extended or adjusted under 35 U.S.C. 154(b) by 0 days. days.

(21) Appl. No.: 15/412,751

(22) Filed: Jan. 23, 2017

Related U.S. Application Data

(60) Provisional application No. 62/446,129, filed on Jan. 13, 2017.

(51) Int. Cl.

| | |
|---|---|
| ***E05B 65/00*** | (2006.01) |
| ***E05C 17/00*** | (2006.01) |
| ***E05F 15/60*** | (2015.01) |
| ***E05C 17/56*** | (2006.01) |
| ***E05C 17/02*** | (2006.01) |

(52) U.S. Cl.
CPC ..... *E05C 17/006* (2013.01); *E05C 17/02* (2013.01); *E05C 17/56* (2013.01); *E05F 15/60* (2015.01); *E05Y 2900/531* (2013.01)

(58) Field of Classification Search
CPC ..... E05C 17/02; E05C 17/56; E05C 17/006; E05F 15/60
USPC ..... 49/364, 276
See application file for complete search history.

(56) References Cited

U.S. PATENT DOCUMENTS

| | | | | |
|---|---|---|---|---|
| 3,451,702 | A * | 6/1969 | Little | D05B 75/06 292/99 |
| 3,605,459 | A * | 9/1971 | Van Dalen | E05B 47/0038 292/144 |
| 4,647,088 | A * | 3/1987 | Nelson | E05B 63/18 292/104 |
| 6,338,536 | B1 * | 1/2002 | Ueno | E05B 17/0033 312/405 |
| 6,357,803 | B1 * | 3/2002 | Lorek | E05C 19/022 292/124 |
| 6,446,391 | B1 * | 9/2002 | Timothy | E05F 11/04 49/330 |
| 6,910,302 | B2 * | 6/2005 | Crawford | E05F 5/12 16/49 |
| 8,584,402 | B2 * | 11/2013 | Yamaguchi | E05F 1/14 312/319.2 |
| 8,739,468 | B2 * | 6/2014 | Yamaguchi | E05F 3/106 312/319.2 |
| 9,003,707 | B2 * | 4/2015 | Reddmann | E05B 81/20 49/275 |
| 2010/0229341 | A1 * | 9/2010 | Tomioka | E05F 1/1066 16/49 |

(Continued)

*Primary Examiner* — Jerry E Redman
(74) *Attorney, Agent, or Firm* — Cantor Colburn LLP

(57) ABSTRACT

A vehicle door opening mechanism includes a biasing structure operatively coupled to a vehicle door, the biasing structure movable between a first position and a second position, a portion of the biasing structure engageable with a vehicle body surface to bias the vehicle door from a closed position to a partially open position. Also included is a retaining structure disposed proximate the portion of the biasing structure that is engageable with the vehicle body surface, the retraining structure retaining the vehicle door in the partially open position to prevent the vehicle door from moving toward a fully open position.

17 Claims, 5 Drawing Sheets

(56) References Cited

U.S. PATENT DOCUMENTS

2011/0254292 A1* 10/2011 Ishii ..... E05B 17/0025
292/341.15

* cited by examiner

VEHICLE DOOR OPENING MECHANISM

CROSS-REFERENCE TO RELATED APPLICATION

This patent application claims priority to U.S. Provisional Patent Application Ser. No. 62/446,129, filed Jan. 13, 2017, which is incorporated herein by reference in its entirety.

BACKGROUND

The subject matter disclosed herein relates to vehicle doors and, more particularly, to a vehicle door opening mechanism.

Traditional vehicle doors include a handle that a user may physically interact with to grasp and open a vehicle door. Recently, some vehicle doors do not include an exterior handle and door opening is facilitated via electromagnetic actuation that is prompted with a user fob or the like. The actuation system may open the door slightly to allow a user to grasp the vehicle door to manually complete the door opening process. In some situations, the door may open suddenly and with substantial force. For example, a high wind condition or a steeply parked car may lead to sudden opening. Rapid and unexpected opening of the vehicle door may potentially and undesirably strike the user or a surrounding object.

SUMMARY

According to one embodiment, a vehicle door opening mechanism includes a biasing structure operatively coupled to a vehicle door, the biasing structure movable between a first position and a second position, a portion of the biasing structure engageable with a vehicle body surface to bias the vehicle door from a closed position to a partially open position. Also included is a retaining structure disposed proximate the portion of the biasing structure that is engageable with the vehicle body surface, the retraining structure retaining the vehicle door in the partially open position to prevent the vehicle door from moving toward a fully open position.

According to another embodiment, a vehicle door assembly includes a vehicle door. Also included is an electronic latch assembly operatively coupled to the vehicle door. Further included is a door opening mechanism operatively coupled to the vehicle door. The door opening mechanism includes an electromechanical mechanism including a biasing structure having a rack that is translatable between a first position and a second position, an end of the biasing structure engageable with a vehicle body surface to bias the vehicle door from a closed position to a partially open position. The door opening mechanism also includes a retaining structure disposed proximate the end of the biasing structure, the retraining structure retaining the vehicle door in the partially open position to prevent the vehicle door from moving to a fully open position.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Referring now to the figures, which are exemplary embodiments, and wherein like elements are numbered alike.

The detailed description explains embodiments of the invention, together with advantages and features, by way of example with reference to the drawings.

DETAILED DESCRIPTION OF THE INVENTION

Figure 1:
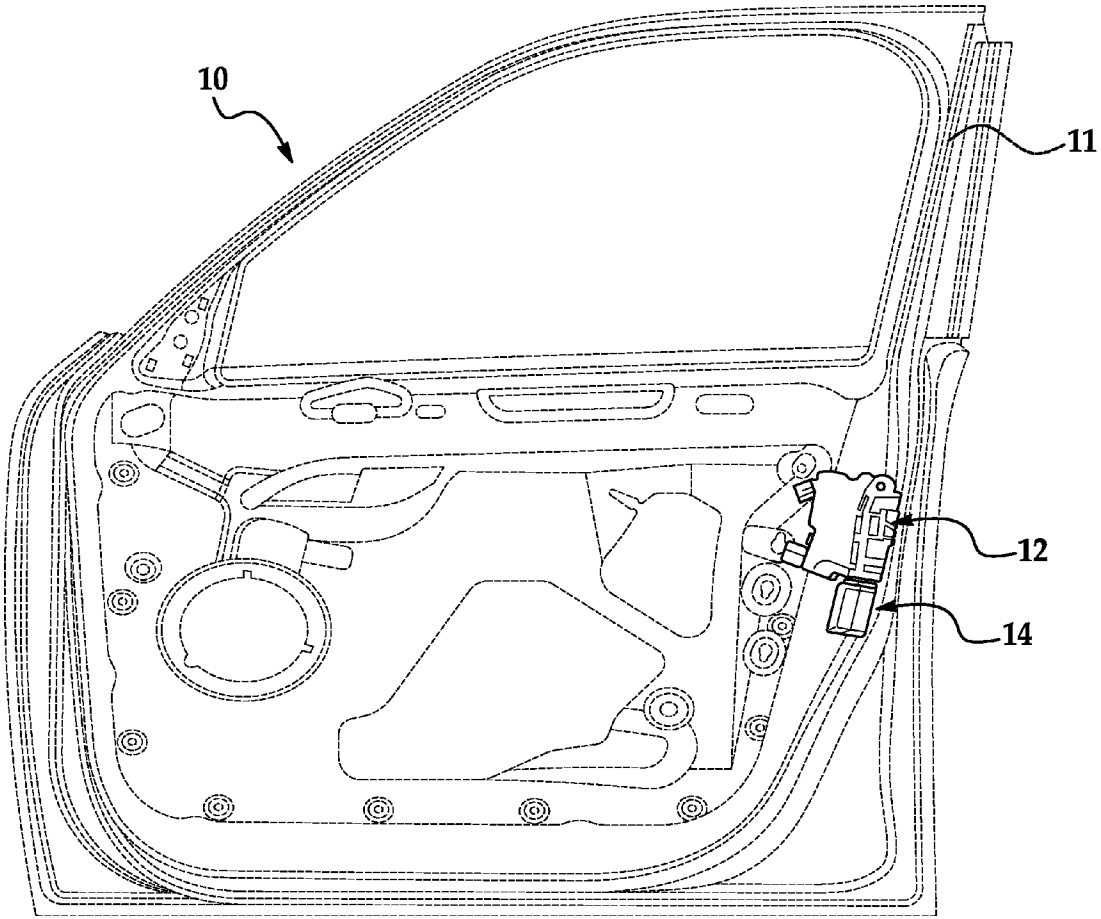
FIG. 1 is a perspective view of a vehicle door with an electromechanical door opening mechanism.

Referring now to FIG. 1, the reference numeral 10 generally designates a vehicle door assembly. The vehicle door assembly 10 may be installed as a driver side door, passenger side door, or rear passenger doors. Additionally, although referred to herein as a vehicle door 11 that is included in the assembly 10, the vehicle door assembly 10 may be installed as a rear door assembly of the vehicle, such as a liftgate, trunk or tailgate, for example. A vehicle latch assembly 12 is operatively coupled to the vehicle door 11 to hold the door (or liftgate, trunk, tailgate, etc.) in a closed position and to release the vehicle door to allow a user to move the vehicle door 11 to an open position. The vehicle latch assembly 12 is an electromechanical latch assembly in some embodiments, thereby providing opening assistance to a user.

In the embodiments described herein, the vehicle door 11 does not include a door handle on the exterior of the vehicle door 11. By not including a door handle, the door may be more aesthetically pleasing and/or provides an additional security measure that inhibits unauthorized access to the vehicle. A keyless entry mechanism or device is employed to initiate a door opening procedure. For example, a fob, mobile device application, keypad, or a similar keyless entry mechanism, may be utilized to actuate door opening. In particular, the vehicle latch assembly 12 is actuated to permit door opening.

Working in conjunction with the vehicle latch assembly 12 is a door opening mechanism 14 that is operatively coupled to the vehicle door 11. In the illustrated embodiment, the door opening mechanism 14 is disposed beneath the vehicle latch assembly 12, but it is to be appreciated that the door opening mechanism 14 may be located adjacent the vehicle latch assembly 12 in an alternative adjacent configuration or spaced therefrom. The door opening mechanism 14 actuates opening of the vehicle door 11 by biasing (e.g., pushing) the vehicle door 11 away from a vehicle body surface 16 (FIGS. 3 and 4), as will be appreciated from the disclosure herein. The vehicle body surface 16 may be any suitable surface that the vehicle door 11 may rotate, or otherwise move away from, to move the vehicle door 11 from the closed position to a partially open position. In some embodiments, the vehicle body surface is a body pillar, such as a B-pillar or C-pillar, for example, but it is to be appreciated that alternative suitable surfaces may be employed to bias the vehicle door 11 away from the closed position.

As used herein, a closed position of the vehicle door 11 refers to a completely closed position of the vehicle door 11, such that the door is not ajar from the vehicle body. A partially open position of the vehicle door 11 refers to an ajar position of the door, relative to the vehicle body, the door spaced from the vehicle body to an extent sufficient to allow a user to insert fingers between the inner panel of the vehicle door 11 and the vehicle body in a manner that permits movement of the vehicle door 11 away from the partially open position to a fully open position of the vehicle door. The fully open position refers to a position that allows a user to enter the vehicle. In some embodiments, the partially open position is defined by a space between the vehicle door 11 and the vehicle body surface 16 of less than about 50 millimeters. In some embodiments, the partially open position is defined by a space between the vehicle door 11 and the vehicle body surface 16 of between about 10 millimeters and about 40 millimeters.

Figure 2:
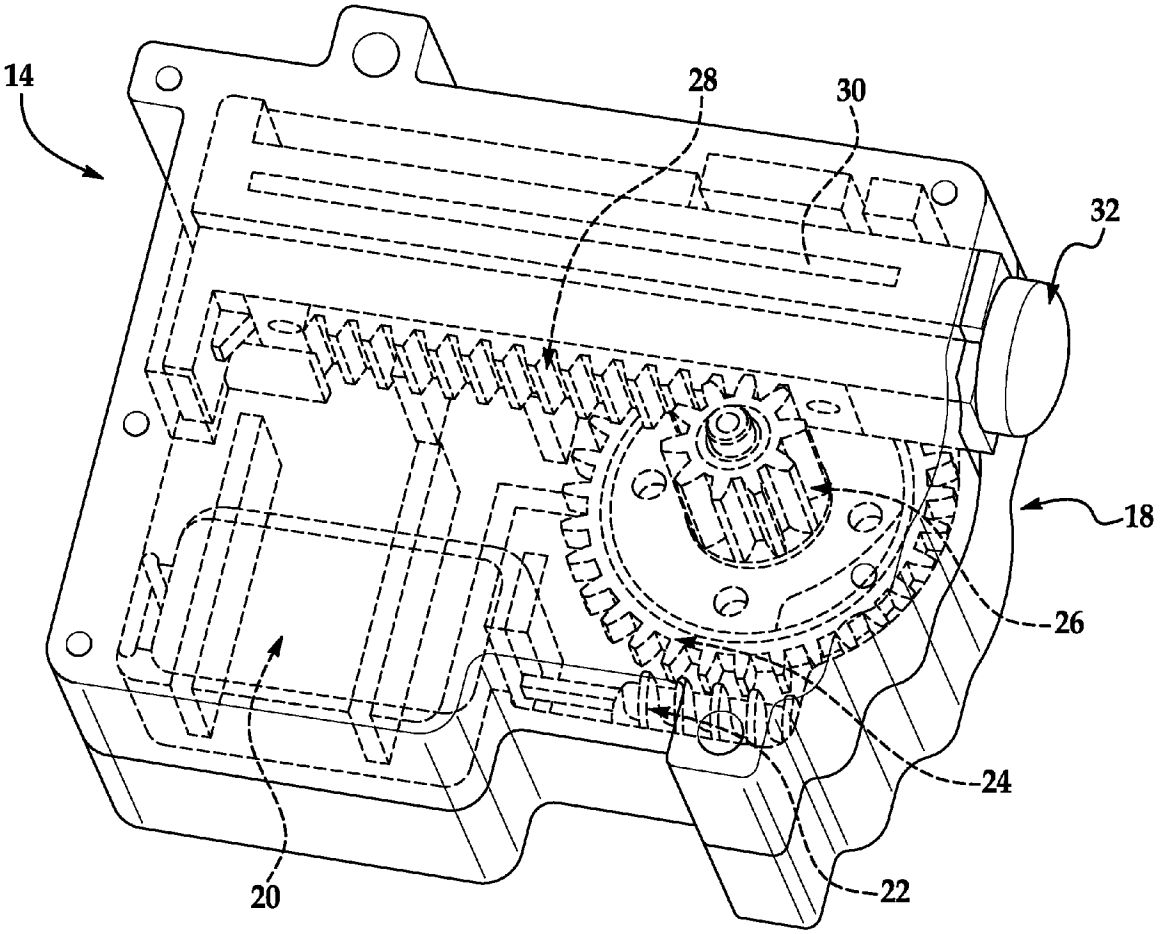
FIG. 2 is a perspective view of the electromechanical door opening mechanism.
Figure 3:
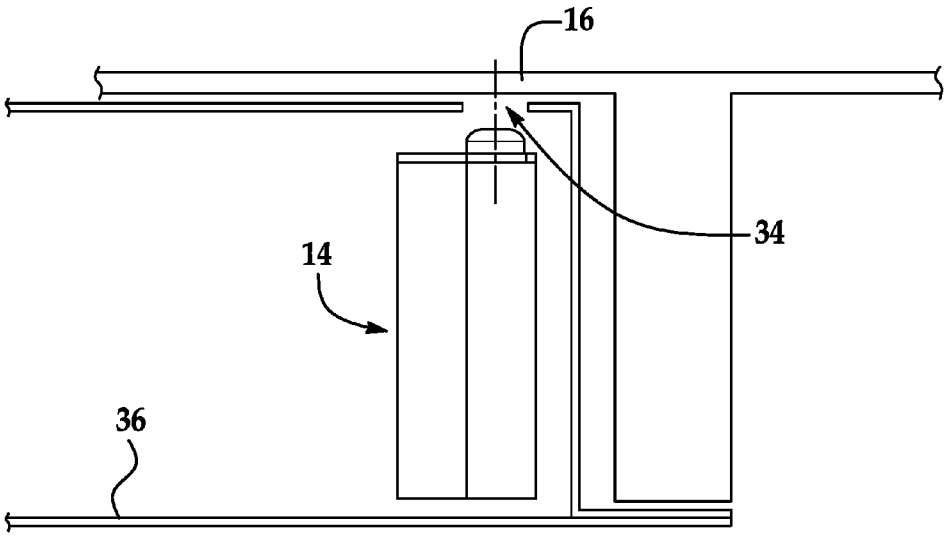
FIG. 3 is a schematic illustration of the electromechanical door opening mechanism with the vehicle door in a closed position.
Figure 4:
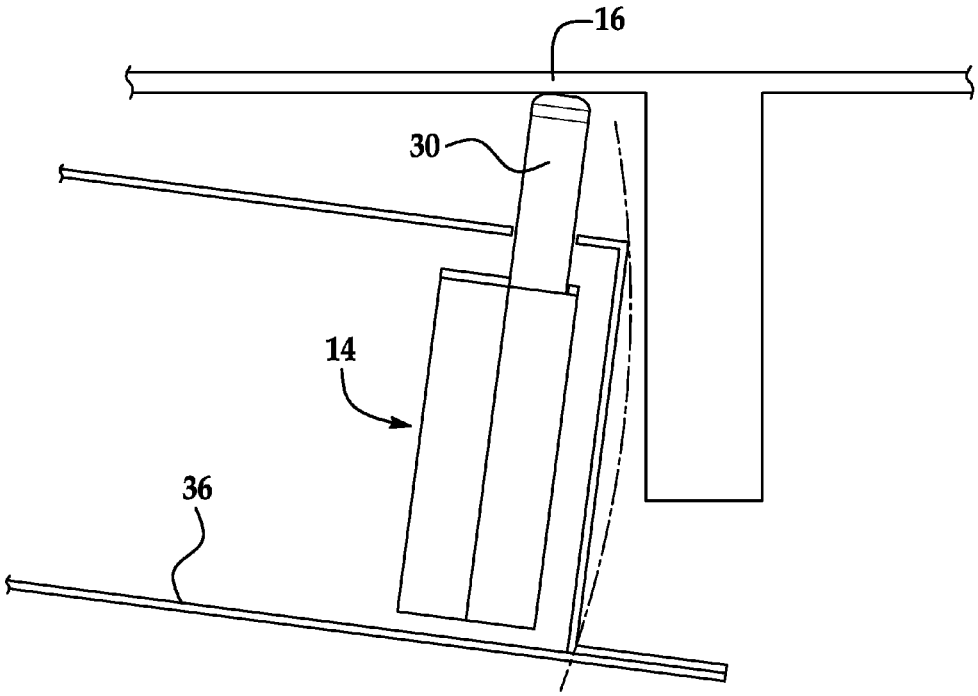
FIG. 4 is a schematic illustration of the electromechanical door opening mechanism with the vehicle door in a partially opened position.

Referring now to FIGS. 2-4, the door opening mechanism 14 is illustrated in greater detail. The door opening mechanism 14 is an electromechanical assembly that includes a gear arrangement 18 driven by an electric motor 20. In the illustrated embodiment, the gear arrangement 18 includes a worm 22 and a worm gear 24 in meshed engagement. The worm 22 is driven by the electric motor 20 upon initiation of the keyless entry mechanism. The worm gear 24 is coupled to a pinion 26 that is in meshed engagement with a rack 28 of a biasing structure 30. Due to the above-described meshed relationships, the biasing structure 30 is translatable in a precisely controlled manner between a first position (FIG. 3) and a second position (FIG. 4). The first position corresponds to the closed position of the vehicle door 11 and the second position corresponds to the partially open position of the vehicle door 11.

As shown in FIGS. 3 and 4, an end 32 of the biasing structure 30 is spaced from the vehicle body surface 16 in the first position (FIG. 3) and extends due to the meshed engagement of the rack 28 and the pinion 26 until the end 32 of the biasing structure 30 engages the vehicle body surface 30. Translation of the biasing structure 30 continues until the biasing structure 30 is in the second position (FIG. 4), thereby placing the vehicle door 11 in a predefined ajar position that corresponds to the partially open position of the vehicle door 11. Movement from the first position to engagement of the end 32 with the vehicle body surface 16 includes translating the end 32 through an aperture 34 of an inner panel 36 of the vehicle door 11 in some embodiments. Although described above and illustrated in FIG. 3 as having a gap between the end 32 of the biasing structure 30 and the vehicle body surface 16, it is contemplated that the end 32 abuts the vehicle body surface 16 in the first position.

In the second position (FIG. 4) of the biasing structure 30, the partially open position of the vehicle door 11 is maintained due to the contact of the end 32 of the biasing structure 30 and the vehicle body surface 16. This position allows a user to insert fingers into the gap provided by the partially open position and prevents closure of the vehicle door 11 on the user's fingers. However, preventing unexpected movement of the vehicle door 11 in the other direction is also desired and accomplished by the embodiments described herein. In particular, the embodiments described herein prevent the vehicle door 11 from moving, perhaps rapidly, from the partially open position toward the fully open position, thereby reducing the likelihood of injury to the user or damage to the vehicle door 11 or surrounding objects.

Figure 5:
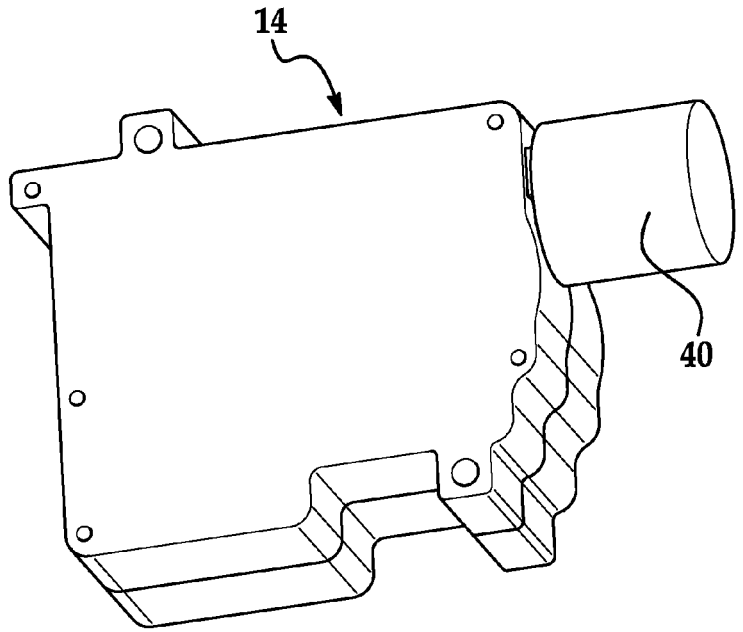
FIG. 5 is a perspective view of the electromechanical door opening mechanism according to an aspect of the disclosure, the mechanism in a first position.
Figure 6:
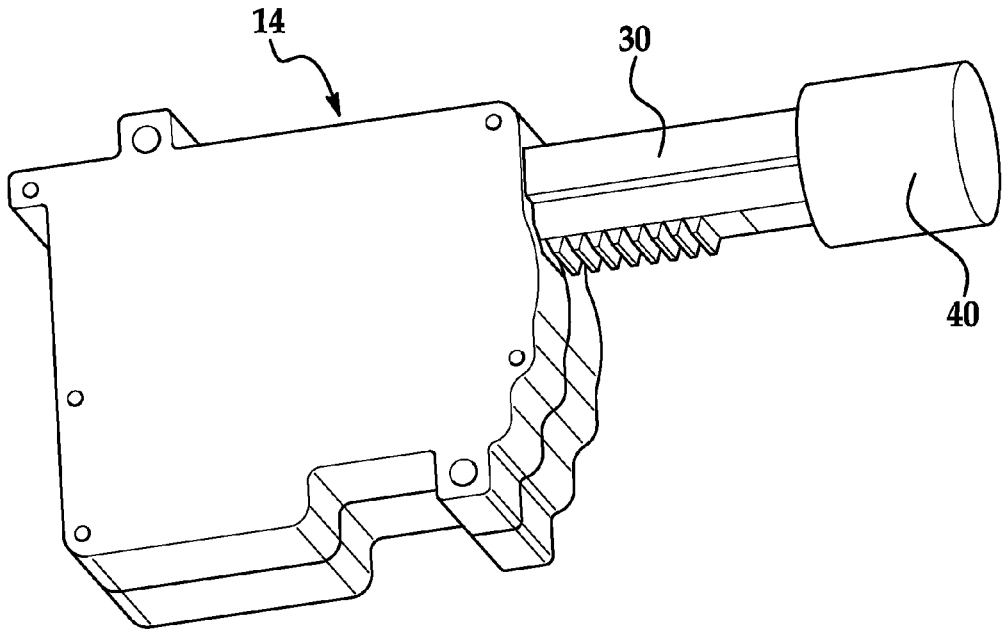
FIG. 6 is a perspective view of the electromechanical door opening mechanism of FIG. 5, the mechanism in a second position.

Referring now to FIGS. 5 and 6, an embodiment of a retaining structure 40 of the door opening mechanism 14 is illustrated. The door opening mechanism 40 is shown in the closed position in FIG. 5 and in the partially open position in FIG. 6. The retaining structure 40 is disposed proximate the portion of the biasing structure 30 that engages the vehicle body surface 16. In particular, the retaining structure 40 is disposed on the end 32 of the biasing structure 30 in some embodiments. The retaining structure 40 retains the vehicle door 11 in the partially open position to prevent the vehicle door 11 from moving toward the fully open position.

In the illustrated embodiment, the retaining structure 40 is a magnet disposed on the end 32 of the biasing structure 30, the magnet engageable with the vehicle body surface 16 to exert a magnetic force to retain the vehicle door 11 in the partially open position. The magnetic force resists forces applied to the vehicle door 11 that are less than a predetermined force. The predetermined force is set based on foreseen forces applied to the vehicle door 11 due to wind and gravity, for example. In some embodiments, the predetermined force ranges from about 40 Newtons to about 60 Newtons. In an embodiment, the predetermined force is about 50 Newtons. However, a magnet as a door retaining structure can provide even more force if the magnetic field is monitored with the addition of a sensor that is described below.

In some embodiments, the magnetic force is maintained through the use of an electromagnetic mechanism or the like. The user must then interact with a user interface to halt the magnetic force, the user interface in operative communication with the biasing structure 30 to stop application of the magnetic force to permit a user to move the vehicle door 11 toward the fully open position. In some embodiments, the user interface is a sensor or the like. The sensor may be located proximate a grasping area of the vehicle door 11 to conveniently allow the user to contact the sensor and complete the door opening process in a continuous motion. For embodiments requiring halting the magnetic force, predetermined forces higher than those discussed above may be employed to further secure against uncontrolled opening of the vehicle door 11. For example, in embodiments that require a sensor to deactivate the magnetic force, the predetermined force is greater than about 100 Newtons to provide additional securement of the vehicle door 11. Alternatively, in some embodiments a user may manually overcome the magnetic force by exceeding the predetermined force to move the vehicle door 11 away from the partially open position and toward the fully open position.

Figure 7:
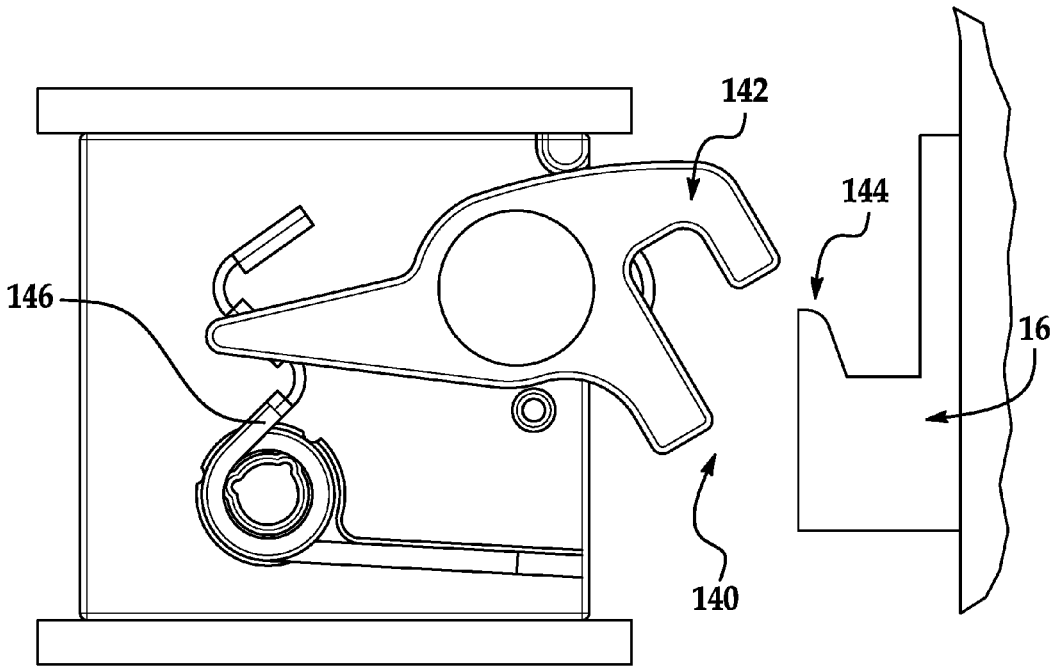
FIG. 7 is a perspective view of the electromechanical door opening mechanism according to another aspect of the disclosure, the mechanism in a first position.
Figure 8:
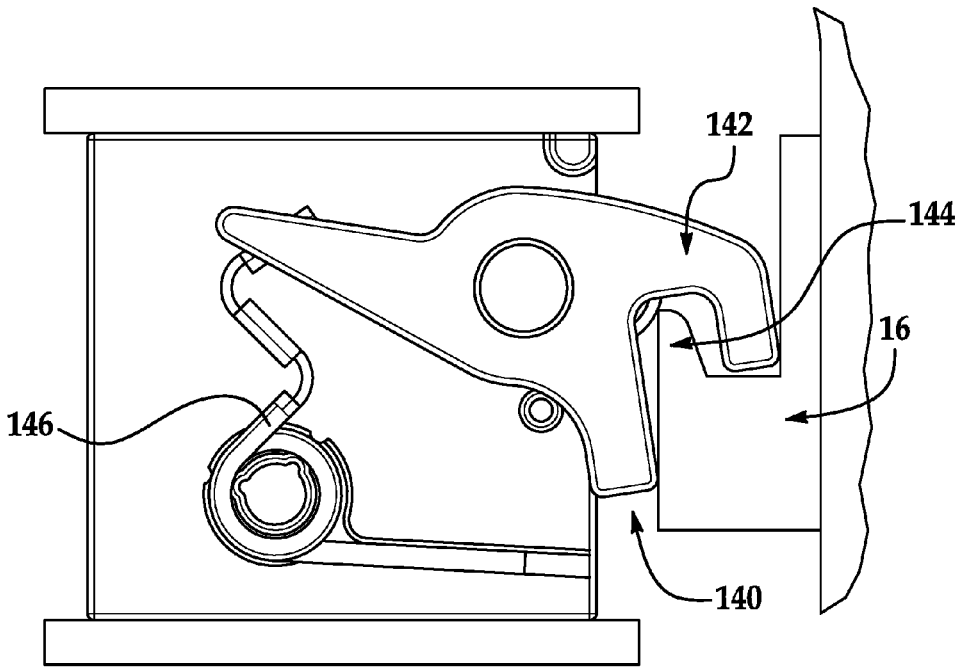
FIG. 8 is a perspective view of the electromechanical door opening mechanism of FIG. 7, the mechanism in a second position.

Referring now to FIGS. 7 and 8, an embodiment of a retaining structure 140 of the door opening mechanism 14 is illustrated. The door opening mechanism 140 is shown in the closed position in FIG. 7 and in the partially open position in FIG. 8. The retaining structure 140 is disposed proximate the portion of the biasing structure 30 that engages the vehicle body surface 16. In particular, the retaining structure 140 is disposed on the end 32 of the biasing structure 30 in some embodiments. The retaining structure 140 retains the vehicle door 11 in the partially open position to prevent the vehicle door 11 from moving toward the fully open position.

In the illustrated embodiment, the retaining structure 140 is a hook 142 disposed on the end 32 of the biasing structure 30, the hook 142 engageable with a toothed portion 144 of the vehicle body surface 16 to retain the vehicle door 11 in the partially open position. The hook 142 is spring biased with a spring 146 to resist forces applied to the vehicle door 11 that are less than a predetermined force. The predetermined force is set based on foreseen forces applied to the vehicle door 11 due to wind and gravity, for example. In some embodiments, the predetermined force ranges from about 40 Newtons to about 60 Newtons. In an embodiment, the predetermined force is about 50 Newtons.

Interaction by the user with the vehicle door 11 deactivates the retaining structure 140 by retracting the hook 142 upon the application of the manual force that exceeds the predetermined force. The predetermined force may be set to any desired force by changing the spring biasing characteristics. Additionally, various closing procedures of the vehicle door 11 may be facilitated with the retaining structure 140, such as moving the vehicle door 11 from an open position to the closed position. For example, when the vehicle door 11 is in the partially opened position, the door opening mechanism 14 can close the door (partially or fully) in the absence of user action.

Advantageously, the embodiments described herein allow for vehicle doors without handles to be retained in a partially open position until a user interacts with the vehicle door. This prevents uncontrolled and undesired movement of the vehicle door during an opening process.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A vehicle door opening mechanism comprising:

a biasing structure operatively coupled to a vehicle door, the biasing structure movable between a first position and a second position, a portion of the biasing structure engageable with a vehicle body surface to bias the vehicle door from a closed position to a partially open position, the biasing structure comprises an electromechanical mechanism including a rack that is translatable between the first position and the second position, the portion of the biasing structure that is engageable with the vehicle body surface being an end of the biasing structure; and a retaining structure disposed proximate the portion of the biasing structure that is engageable with the vehicle body surface, the retraining structure retaining the vehicle door in the partially open position to prevent the vehicle door from moving toward a fully open position.

2. The vehicle door opening mechanism of claim 1, wherein the partially open position is an ajar position of the vehicle door.

3. The vehicle door opening mechanism of claim 2, wherein the ajar position is defined by a space between the vehicle door and the vehicle body surface of less than 50 millimeters.

4. The vehicle door opening mechanism of claim 1, further comprising:

an electric motor; and a gear arrangement driven by the electric motor, the gear arrangement driving the rack.

5. The vehicle door opening mechanism of claim 1, wherein the retaining structure comprises a magnet disposed on the end of the biasing structure, the magnet engageable with the vehicle body surface to exert a magnetic force to retain the vehicle door in the partially open position.

6. The vehicle door opening mechanism of claim 5, further comprising a user interface located on the vehicle door, the user interface in operative communication with the biasing structure to stop application of the magnetic force to permit a user to move the vehicle door toward the fully open position.

7. The vehicle door opening mechanism of claim 6, wherein the user interface comprises a sensor.

8. The vehicle door opening mechanism of claim 6, wherein the predetermined force is greater than about 100 Newtons.

9. The vehicle door opening mechanism of claim 5, wherein the magnetic force resists forces applied to the vehicle door that are less than a predetermined force, a user manually overcoming the magnetic force by exceeding the predetermined force to move the vehicle door toward the fully open position.

10. The vehicle door opening mechanism of claim 1, wherein the retaining structure comprises a hook disposed on the end of the biasing structure, the hook engageable with a toothed portion of the vehicle body surface to retain the vehicle door in the partially open position.

11. The vehicle door opening mechanism of claim 1, wherein the hook is spring biased to determine a predetermined force required to resist forces applied to the vehicle door that are less than a predetermined force, a user manually moving the vehicle door toward the fully open position by exceeding the predetermined force.

12. The vehicle door opening mechanism of claim 11, wherein the predetermined force ranges from 40 Newtons to 60 Newtons.

13. The vehicle door opening mechanism of claim 1, wherein the vehicle body surface that the portion of the biasing structure is engageable with is a surface of a vehicle B-pillar.

14. The vehicle door opening mechanism of claim 1, wherein the vehicle body surface that the portion of the biasing structure is engageable with is a surface of a vehicle C-pillar.

15. A vehicle door assembly comprising:

a vehicle door;

an electronic latch assembly operatively coupled to the vehicle door; and a door opening mechanism operatively coupled to the vehicle door, the door opening mechanism comprising:

an electromechanical mechanism including a biasing structure having a rack that is translatable between a first position and a second position, an end of the biasing structure engageable with a vehicle body surface to bias the vehicle door from a closed position to a partially open position; and a retaining structure disposed proximate the end of the biasing structure, the retraining structure retaining the vehicle door in the partially open position to prevent the vehicle door from moving to a fully open position.

16. The vehicle door assembly of claim 15, wherein the retaining structure comprises a magnet disposed on the end of the biasing structure, the magnet engageable with the vehicle body surface to exert a magnetic force to retain the vehicle door in the partially open position.

17. The vehicle door assembly of claim 15, wherein the retaining structure comprises a hook disposed on the end of the biasing structure, the hook engageable with a toothed portion of the vehicle body surface to retain the vehicle door in the partially open position.

* * * * *